United States Patent [19]

Cugini

[11] 3,933,376

[45] Jan. 20, 1976

[54] REMOVABLE PACKER AND TENSION SLIP ASSEMBLY

[75] Inventor: Edward T. Cugini, Brea, Calif.

[73] Assignee: Grant Oil Tool Company, Los Angeles, Calif.

[22] Filed: Dec. 13, 1973

[21] Appl. No.: 424,289

[52] U.S. Cl. ..... 285/23; 285/145

[51] Int. Cl.[2] ..... F16L 55/00; F16L 57/00; F16L 21/00

[58] Field of Search ..... 285/138, 140, 141, 144, 285/145, 146, 147, 148, 18, 23; 166/208, 217

[56] References Cited

UNITED STATES PATENTS

| | | | |
|---|---|---|---|
| 2,315,134 | 3/1943 | Roach et al. | 285/144 |
| 2,568,581 | 9/1951 | Crain | 285/146 |
| 2,690,344 | 9/1954 | Allen | 285/146 |
| 2,850,301 | 9/1958 | Allen | 285/148 |
| 3,068,027 | 12/1962 | Lewis et al. | 284/144 |
| 3,209,829 | 10/1965 | Haeber | 285/145 |

*Primary Examiner*—Thomas F. Callaghan
*Assistant Examiner*—Wayne L. Shedd

[57] ABSTRACT

A packer and tension slip assembly is disposed in the annular area between two coaxial drilling casings having different diameters. The coaxial casings are secured one to the other by placing the inner casing in tension with the outer casing. A packoff unit is attached to and completes the assembly forming an pressure tight seal in the defined annulus. The packer and tension slip assembly also serves to center one string in respect to the other and can be retrieved when no longer required, and subsequently reused.

16 Claims, 5 Drawing Figures

Fig. 1
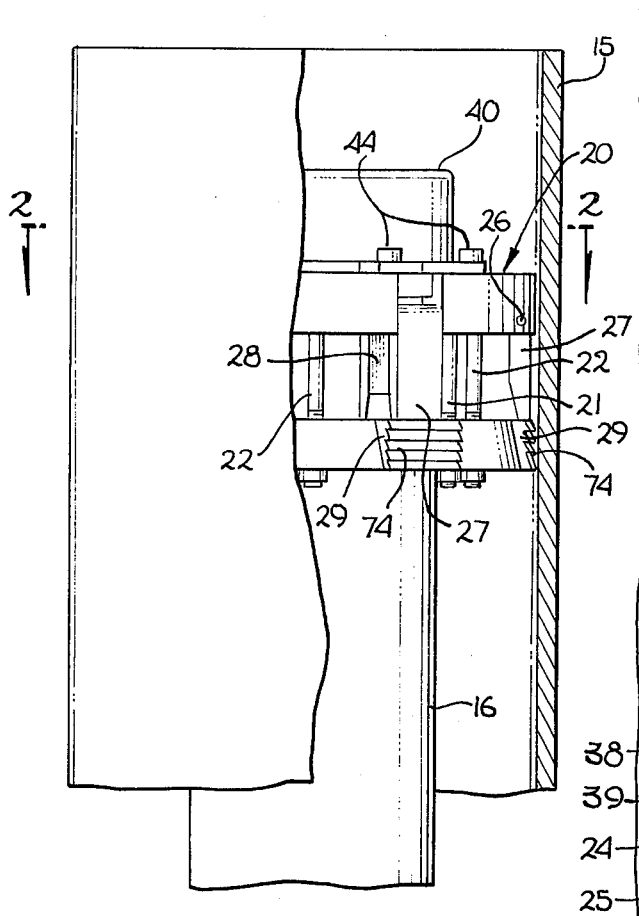
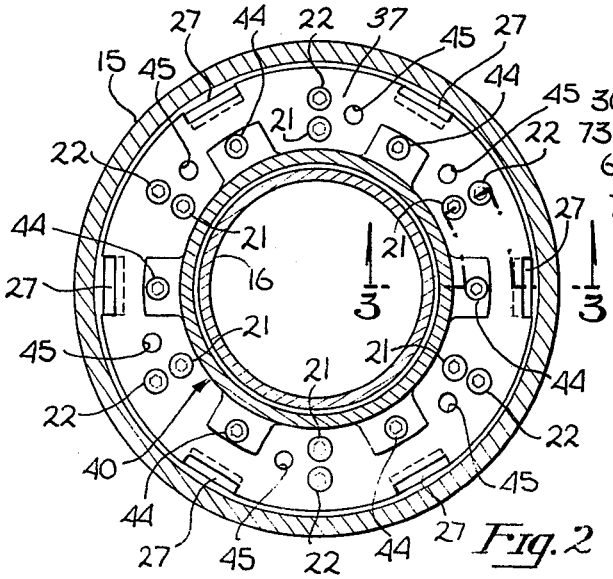
Fig. 2
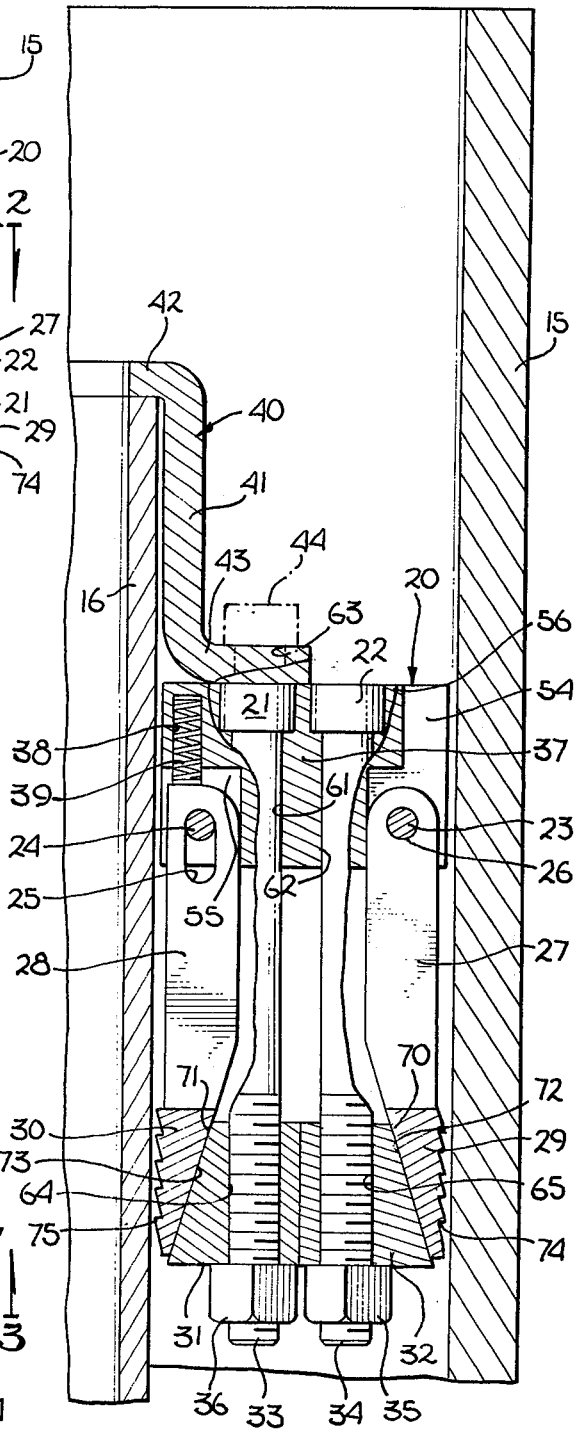
Fig. 3

REMOVABLE PACKER AND TENSION SLIP ASSEMBLY

BACKGROUND OF THE INVENTION

1. Field of the Invention

This invention relates to an assembly which will lock one drill string to another and form a pressure seal.

2. Prior Art

The present invention is a device which can be installed in the annulus between two coaxial drill strings and will; lock one string, in tension, with regard to the other, form a pressure tight seal, and center one string with the other. The device may be used in most drilling operations, however, it is particularly suitable for use in offshore drilling installations.

In any drilling operation it is possible to have some impairment occur which limits the ability to continue drilling operations, this is commonly referred to as losing the hole. However, in offshore drilling this problem is compounded due to the large distance between the drilling platform and the ground surface, or mudline. If some disaster or problem arises which causes the hole to be lost, the capability of recovering the hole must exist. Thus, in most offshore drilling operations a large first casing is drilled to a given depth below the mudline, then a second smaller casing is drilled through the first larger casing to a greater depth, a third and smaller casing may then be used to drill to any given depth through the first and second casings. The present invention is used to secure and seal the first two casings one to the other. The present invention is placed immediately after the second casing is drilled into its final position and remains in position until it is no longer needed.

In the drilling industry there exists many prior art methods for packing off (sealing) one portion of a casing, or for sealing one casing off with respect to the other. However, these devices serve only to provide a seal and do not secure one casing to the other. A separate problem is that prior art devices are not recoverable and when positioned, become a permenant part of the casing. There also exists devices for centering one string of casing with respect to the other, however, the device does not secure one string to the other, nor pack off the annulus.

The present invention attempts to solve these problems by providing a device which will pack off, center and secure one coaxial string of casing to the other. An additional feature is that the device is retrievable and may be reused.

SUMMARY OF THE INVENTION

The present invention is a device which may be employed in drilling operations to secure an inner coaxial casing string to an outer coaxial casing, and to provide a pressure seal for the annulus between the coaxial casing strings. The securing portion of the device is comprised of an upper supporting ring which has a plurality of inner and outer circumferentially disposed slip arms having corrugated feet which engage the inner and outer casing walls. The corrugated feet are adjustably mounted such that the outer feet can be secure against the outer casing while the inner feet are secured against the inner casing. Then by adjusting the verticle placement of the inner slip arm the inner casing is placed in tension in relation to the outer casing. A resilient sealing ring is mounted over the upper supporting ring and held in place by an upper packing ring. The upper packing ring is able to be secured to the upper support ring by a plurality of bolts. Tightening of these bolts compresses the packing ring and provides a pressure tight seal.

It is an object of this invention to provide a device which will secure one coaxial string to another and seal the annulus there between.

It is another object to provide a device for sealing and securing which is retrievable.

BRIEF DESCRIPTION OF THE DRAWINGS

FIG. 1 is a cut away side view of the upper end of the coaxial casings showing the present invention installed in place;

FIG. 2 is a section view taken along line 2—2 of FIG. 1;

FIG. 3 is a section view taken along line 3—3 of FIG. 2 showing the slip portion of the assembly and the temporary spacing and support plate;

DETAILED DESCRIPTION OF THE PREFERRED EMBODIMENT

Figure 5:
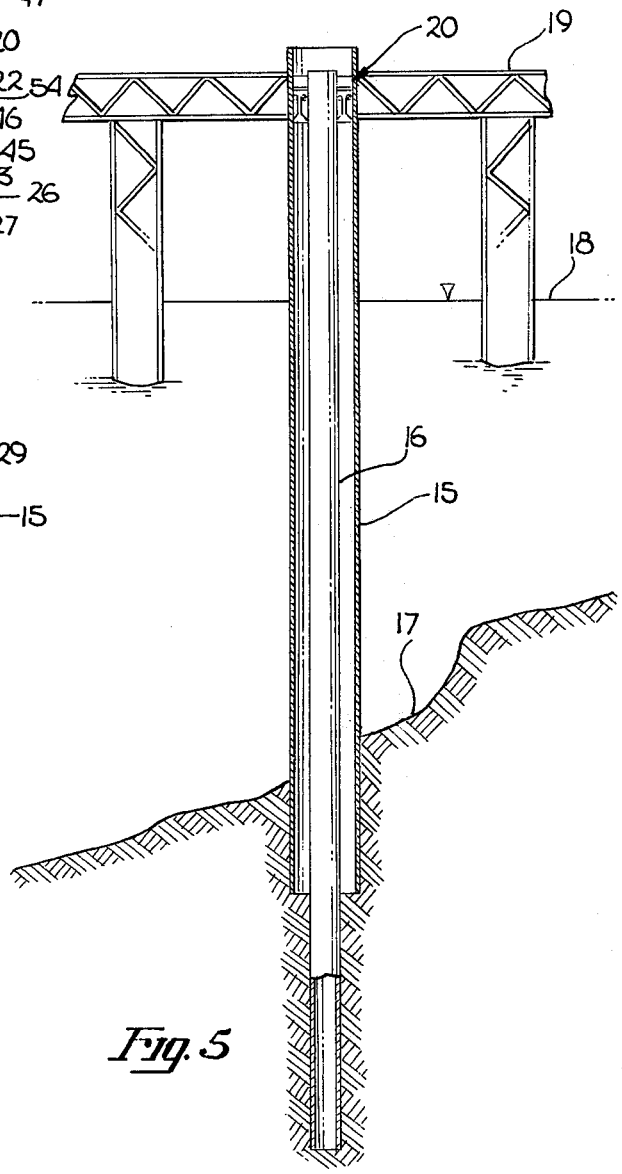
FIG. 5 is a sectional view of an offshore drilling platform and coaxial casing utilizing the present invention.

The presently preferred embodiment of the invention is shown diagrammatically in FIG. 5 to illustrate the environment and the application of the present invention. The packer and tension slip assembly 20 shown in place, in FIG. 5, is located between two coaxial casing strings 15 and 16. The outer casing 15 is larger in diameter than the inner casing 16. In offshore drilling operations, the larger outer casing 15 is normally drilled to a specified depth below the mudline 17. An inner casing 16 having a smaller diameter is then drilled through the outer casing to a greater depth than the outer casing 15. This step diameter reducing method of drilling a hole is especially essential in offshore drilling operations because of the increased possibility of an emergency or problem arising in which the casings may break or become damaged somewhere between the deck 19 and the mudline 17. If this step diameter reduction procedure is used it is possible to cap or recover the drill hole at the mudline 17.

The present invention is employed near the deck level 19 of the casings, as shown generally in FIG. 5 and in detail in FIG. 1. The device serves to pack off (pack off is a term which refers to the ability to seal some portion of a casing or to seal one casing to another in order that pressurized drilling or other operations may continue), center one casing the relation to the other casing, allow a third casing to be drilled through the inner casing and hold the inner casing in tension with respect to the outer casing. An additional feature of the device is that it is retrievable and may be reused.

The device 20 (FIG. 4) is basically comprised of: an upper supporting ring 37 having a plurality of inner and outer slip arms 28 and 27, an inner and outer slip setting ring 31 and 32, a packing ring assembly 60 having an upper and lower packing ring 47 and 49 with a resilient packing ring 48 disposed therebetween, and a spacer and support plate 40 (FIG. 3) which is used to position and retrieve the assembly 20.

The upper supporting ring 37 forms the basic body of the assembly 20. It is generally annular in shape having an inner diameter slightly larger than the outer diameter of the inner casing 16 and an outer diameter slightly smaller than the inner diameter of the outer casing 15. The depth of the annular support ring 37 is not critical except it must provide sufficient rigidity. This annular supporting ring has a top surface 56 and a bottom surface 57. Around the outer periphery of the annular supporting ring 37 are disposed a plurality of generally rectangular shaped slots 54 which extend through the thickness of the annular supporting ring. Thus, when the upper support ring 37 is viewed from the top as in FIG. 2, the annular support ring 37 has a plurality of recesses or slots 54 around its outer periphery. On one of the sides of slot 54, which extend perpendicular to the outer periphery, is disposed a threaded pin 23 which is capable of receiving an aperture in the end of the outer slip arm 27. The slot 54 is of sufficient dimension so as to allow the end of the outer slip arm 27 to be disposed in the slot and on pin 23. Also disposed cirumferentially around the inner periphery of the annular upper support ring is a plurality of recessed slots 55 disposed in alignment with the slot recess 54. This rectangular recessed slot 55 also contains a threaded pin 24 which is capable of being disposed through a slot in the inner slip arm 28. This inner recessed slot 55 is also capable of containing the inner slip arm 28 and providing sufficient area for the inner slip arm 28 to rotate freely about pin 24. This recessed slot 55 is disposed into the upper support ring 37 from the bottom 57, but does not extend through the upper support ring 37. A circular recess 38 extends from the base of the recessed slot 55 still further upward into the upper support ring 37, but does not extend through the upper support ring. The circular recess 38 is capable of receiving a circular spring 39.

The upper support ring 37 has a plurality of pairs of apertures 61 and 62 disposed circumferentially around and through the upper support ring 37. These apertures 61 and 62 allow the inner and outer cap bolts 21 and 22 to be disposed through the upper support ring 37, as best shown in FIG. 2. These apertures 61 and 62 are counter bored to allow the heads of the inner and outer cap bolts 21 and 22 to be disposed so as to be flush with the top 56 of the upper support ring. Also, disposed circumferentially around the upper support ring are a plurality of apertures 45 which are threaded but do not extend through the upper support ring, also shown in FIG. 2. These apertures 45 are to receive bolt 53 (FIG. 4) which secures the packing ring assembly 60 in position. A third set of apertures is disposed circumferentially around the upper support ring to receive bolt 44 which secures the spacing and support plate to the upper support ring 37. These apertures 63 do not extend through the upper support ring and are threaded to receive bolt 44.

Figure 4:
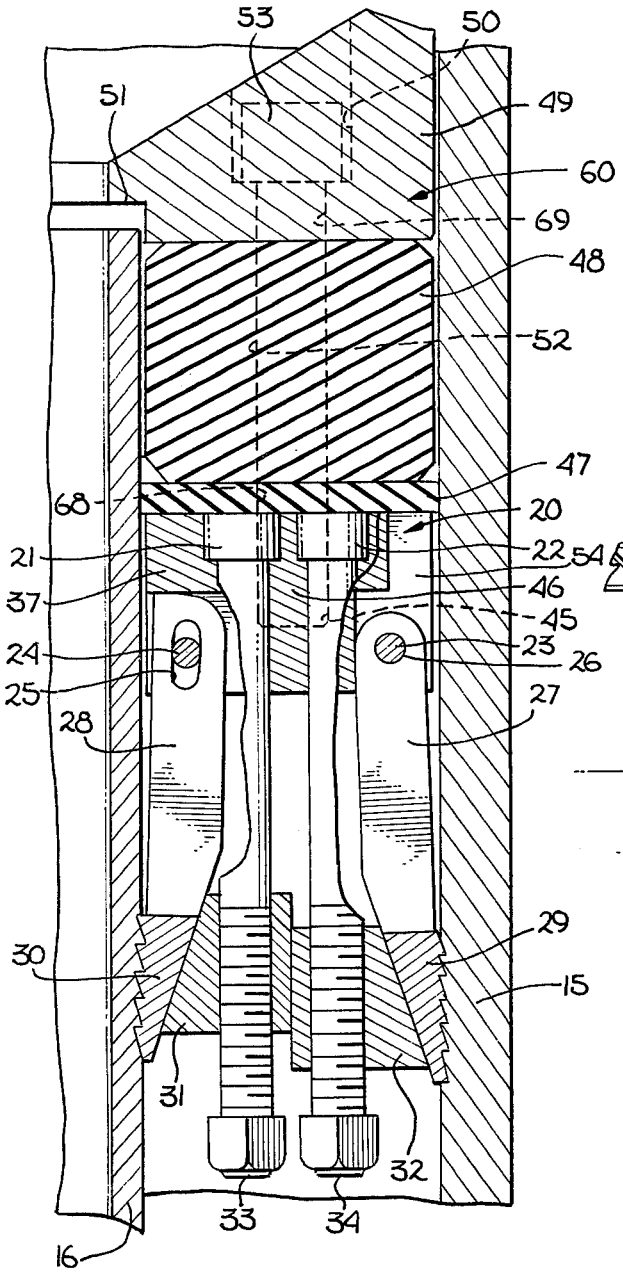
FIG. 4 is a section view taken along line 4—4 of FIG. 2 showing the invention in position.

A plurality of outer slip arms 27 (FIG. 3) are circumferentially disposed in each of the circumferentially disposed slots 54 on pins 23. The outer slip arms 27 each have a body which is generally rectangular in cross section and elongated in shape (FIG. 3 and FIG. 4). The outer slip arms 27 extend downward from the bottom 57 of the upper support plate. One end of the outer slip arm 27 contains an aperture 26 which is disposed on pin 23 and may be contained in place by a nut or other locking means. It is especially important, however, that the fastening means allow the outer slip arm to freely rotate on pin 23 within the slot 54. The opposite end of the outer slip arm contains a foot 29. The foot 29 is generally arcular in shape, triangular in cross section. The outer arcular periphery of the foot 29 is formed to the same diameter as the inner diameter of the outer casing. The foot 29 however, only extends radially around a portion of the arc. Side 74 of the foot 29 which faces the wall of the outer casing has a plurality of surfaces in a generally corrugated pattern so as to be able to grip into the wall of the outer casing. The opposite side 70 of the foot 29 is beveled and intersects the bottom of side 74 such that the foot 29 appears to be generally triangular in shape, best shown in FIG. 3. This inclined face 70 engages the inclined face 72 of the outer slip setting ring 32. In addition, to side 72 of the foot being inclined a portion of the body of the outer slip arm is tapered to allow the outer slip setting ring to be disposed upwardly without contacting the body of the slip arm.

The inner slip arm 28 is formed in much the same manner as the outer slip arm 27, a body, a foot 30 with a corrugated side 75 for engaging the wall of the inner casing, and an inclined side 71 which is engagable with the inclined side 73 of the inner slip setting ring 31. The only distinction between the inner and outer slip arm is that the inner slip arm has a slotted aperture 25, as shown in FIG. 3, which is disposed over pin 24. This slot extends longitudinally along the body of the inner slip arm and allows the inner slip arm to be displaced vertically in addition to radially in relation to pin 24.

The inner slip setting ring 31 is annular in shape and has a rectangular cross-section with side 73 being inclined. The outer diameter of the inner slip setting ring 31 bisects the annulus between the casings. The inner diameter of side 73 varies from top to bottom thereby forming the inclined surface which is engagable with the inclined surface 71 of the foot 30. When the inner slip ring 31 is disposed in position as shown in FIG. 4, the inner diameter of the bottom of side 73 is smaller than the upper diameter of side 73. Thus, as the inner slip setting ring is disposed vertically upward, the engagement of the inclined surfaces forces the foot 30 to dispose radially upward toward the inner casing. The inner slip setting ring 31 also has a plurality of apertures 64 disposed circumferentially through it which are in alignment with apertures 61 in the upper supporting ring 37. These apertures 64 allow the inner cap bolts 21 to be disposed therethrough, and allow a nut 36 to be engaged with the threaded end of the inner cap bolt.

The outer slip setting ring 32 is the mirror image of the inner slip setting ring 31 and is disposed such that the inclined end can be disposed so as to engage the inclined surface of foot 29 while the inner perphery engages the outer perphery of the inner slip setting ring 31. Apertures 65 are threaded through the outer slip setting ring 32. These apertures 65 are to receive the outer cap bolt 22 which extends through the outer slip setting ring 32.

The spacer and support plate 40 is generally annular in shape and best illustrated in FIG. 3. The cross section of the spacing and support plate 40 is generally Z-shaped, having an upper flange 42, a bottom flange 43 and a web 41. The upper flange 42 serves to engage the end of the inner casing 16 while the bottom flange is fastened to the top of the upper support ring 37. Flange 43 has a plurality of circumferentially disposed apertures which are aligned with apertures 45 in the upper support ring 37. The spacer and support plate 40 is disposed such that web 41 is parallel the wall of the inner casing 16, and the aperture 63 in flange 43 is aligned with apertures 45 in the upper support ring 37. Bolts 44 are disposed through the bottom flange 43 into the upper support ring 37 and and thereby secure the spacing and support plate 40 to the slip assembly 20. The spacing and support plate 40 is for temporary use and is used to position the slip assembly 20 until the feet 29 and 30 are engaged with the walls of the casing, and thereby secure the assembly 20 in position. Once the slip assembly 20 is secured in position by feet 29 and 30, the spacing and support plate 40 is removed since the slip assembly 20 will secure itself in position. It is an additional feature of this invention to provide a retrievable slip and packing assembly 20, consequently the upper spacing and support plate may be used to retrieve the slip assembly 20.

The packing portion 60 of the assembly 20, best shown in FIG. 4, is comprised of: a top and bottom spacing ring 49 and 47, a bolt 53 and a resilient packing ring 48. The bottom packing ring 47 is annular in shape and has a generally rectangular cross section. The bottom packing ring 47 is sized such that it fits over the top of the slip assembly 20 in the annular area between the inner and outer casings. The bottom packing ring 47 is formed from a metal and is solid except for a plurality of apertures 68 which are in alignment with apertures 45 in the upper supporting ring 37. The apertures 68 are threaded to allow bolt 53 to be disposed therethrough.

The upper packing ring 49 is also annular in shape, but has a generally triangular shaped cross section, as best illustrated in FIG. 4. The outer diameter of the upper packing ring 49 is slightly smaller than the inner diameter of the outer casing 15. The inner diameter of the upper packing ring 49 is approximately equal to the inner diameter of the inner diameter of the inner casing 16. The thickness of the upper packing ring 49 varies and consequently the upper surface is generally inclined. The thickness of the upper packing ring 49 is smallest near the inner casing 16 and largest near the outer casing 15. A small recess 51 is formed on the bottom surface of the upper packing ring 49 near the inner casing 16 such that the upper packing ring will engage the end and wall of the casing 16. The upper packing ring 49 has a plurality of apertures 69 disposed therethrough, in alignment with apertures 45 and the upper support ring 37 to allow bolts 53 to be disposed therethrough. Each aperture 69 is counter bored 50 such that the head of bolt 53 will not extend into or beyond the top of the upper packing ring 49.

The resilient packing ring 48 is annular in shape and has a generally rectangular cross section. The packing ring is normally formed from a heavy rubber or neoprene material or any other suitable sealing expanding type of material. The outer diameter of the packing ring is slightly smaller than the inner diameter of the outer casing 15 and the inner diameter of the packing ring 48 is slightly larger than the outer diameter of the inner casing 16. Thus, when the packing ring 48 is disposed in position it will fit into the annular area between the inner and outer casing. The packing ring 48 has a plurality of apertures 52 disposed therethrough, in alignment with aperture 45 in the upper support ring 37 for receiving bolt 53. The packing ring 48 must be compressable such that when bolt 53 is engaged with the upper support ring 37 and tightened that is expands and thereby seals the annular area between the two casings.

Having now described the physical characteristics of the packing and tension slip assembly 20, a typical use of the present invention will be described. Initially the outer and inner slip arms 27 and 28 must be mounted on respective pins 23 and 24, in addition, the springs 39 must be disposed in recesses 38 such that when it is in its initial position it urges the inner slip arm downward such that pin 24 engages the top of slot 25 as best illustrated in FIG. 3. The inner and outer cap bolts 21 and 22 are then disposed through the upper support ring 37 and are threaded through the inner and outer slip setting rings 31 and 32. Nuts 36 and 35 are then disposed on the threaded ends 31 and 34 of the inner and outer cap bolts 21 and 22. However, the lock nuts 35 and 36 should not be positioned such that the inner and outer slip setting rings force the feet 29 and 30 of the outer and inner slip arms into their extended positions. The bolt should allow the inner and outer slip setting rings to be disposed such that the feet 29 and 30 are in their collapsed position as illustrated in FIG. 3. The spacing and support plate 40 is then fastened to the upper support ring by bolts 44.

The slip portion of the assembly 20 is then lowered into the annulus between the two casings with the spacing with the support plate temporarily attached thereto, as best illustrated in FIG. 3. The plurality of outer slip arms 27 are then engaged with the outer casing 15, by tightening the outer cap bolt 22 which causes the outer slip setting ring 32 to move upward. This results in the foot 29 and outer slip arm 27 rotating about pin 23 until foot 29 engages the outer casing 15. The inner slip arm arms 28 are then positioned by tightening the inner cap bolts 21. This tightening of inner cap bolts 21, causes the inner casing to be stretched as the inner slip arm is forced to dispose vertically upward, as pin 24 moves along slot 25. Spring 39 initially held the inner slip arm 28 down but after the feet are set, the inner slip arm may be disposed vertically upward. It should be noted that tensioning of the casings is possible because of the frictional force which the earth exerts against the embedded end of the casing. Without this force, the casings would displace and not become tensioned.

After the inner and outer slip arms are set and the inner string tensioned, as illustrated in FIG. 4, the spacing and support plate 40 may be removed by disengaging bolts 44. The bottom packing ring 47 is then disposed over the top 56 of the upper support ring 37. Next, the resilient packing ring 48 is disposed in position on top of the bottom ring 47. Last, the upper packing ring 49 is disposed on top of the resilient packing ring 48. The packing unit 60 is then secured in place by disposing bolt 53 through the upper packing ring 49, resilient packing ring 48, bottom packing ring 47 and into the aperture 45 in the upper support ring 37. As bolt 53 is tightened, the resilient packing ring 48 is compressed and forms a seal between the inner and outer casing. This seal prevents any moisture from entering or leaving the annulus between the casings, whether the moisture is under pressure or not.

Another feature of the present invention is that the packing unit and slip assembly are retrievable. It is retrievable by first removing the packing unit by; unfastening bolt 53 and removing the upper packing ring 49, the resilient packing ring 48 and lower packing ring 47. Next, the spacing and support plate 40 is disposed in position in the annulus and bolted to the top of the upper support ring 37 by bolts 44. The inner and outer slip arms 27 and 28 can be disengaged by loosening cap bolts 21 and 22. The cap bolts cannot completely disengage due to stop nuts which are disposed at the end 33 and 34 of the inner and outer cap bolts. When the inner and outer cap bolts are loosened to the point where these stop nuts prevent further rotation, the inner and outer slip setting rings 31 and 32 can be disengaged from both casings by striking the head of the inner and outer cap bolts 21 and 22 with a hammer. This forces the slip setting rings 31 and 32 downward allowing the slip arms 27 and 28 to rotate and become disengaged with the walls of the casings. The complete assembly 20 can then be removed from the annular hole between the casings, and later reused.

I claim:

1. A device for securing an inner coaxial pipe to an outer coaxial pipe and for forming a seal in the annulus between said coaxial pipes, comprising:

a. locking means having a plurality of circumferentially disposed engaging means, each said engaging means having first and second sides, said first side arranged and configured to selectively engage the walls of said coaxial pipes such that one of said coaxial pipes is placed in tension with respect to the other and held in position, said second side having at least one inclined surface which matingly engages with one of two setting rings, said setting rings being positioned in said annulus such that selective movement of said setting rings causes said first side of said engaging means to be disposed against the walls of said coaxial pipes; and b. a temporary spacing and support plate coupled to said locking means positioning said locking means until said locking means is secured by said engaging means and supporting said locking means during retrieval of said locking means, said support plate arranged and configured in said device so as to be completely removable therefrom;

whereby said temporary spacing and support plate may be coupled to said locking means until said locking means is secured in position, after which said spacing and support plate may be removed without affecting said locking means.

2. The device of claim 1 wherein said engaging means are pivotly mounted on said locking means and have corrugated surfaces which selectively engage the walls of said coaxial pipes.

3. The device of claim 2 wherein said engaging means are disposed circumferentially, at least one being adjacent to said inner casing an at least one being adjacent to said outer casing so as to be disposed vertically in relation to said coaxial pipes, after being secured in position so as to place one of said coaxial pipes in tension with relation to the other.

4. The device of claim 1 wherein said spacing and support plate is annular in shape with a web and two flanges forming a Z-shaped cross section, one flange being capable of engaging the end of one of said coaxial pipes, while the other flange being capable of being secured to said locking means.

5. The device of claim 1 wherein said setting rings have a generally rectangular cross section.

6. The device of claim 1 wherein said locking means are coupled to pin means such that said locking means may rotate thereabout.

7. The device of claim 1 wherein said locking means have arm members, said arm members disposed in said annulus between said coaxial pipes in a generally downward direction.

8. The device of claim 7 wherein, in addition thereto, bolt means are coupled to said setting rings, said bolt means for selectively raising and lowering said setting rings such that said engaging means are selectively disposed against said walls of said coaxial pipes.

9. The device of claim 1, wherein said locking means and said temporary spacing and support plate are coupled to an upper supprt ring, said upper support ring having an annular shape with an inner diameter slightly larger than the diameter of said inner coaxial pipe and an outer diameter slightly less than the diameter of said outer coaxial pipe.

10. A device for securing an inner coaxial pipe to an outer coaxial pipe, and for forming a seal in the annulus between said coaxial pipes, comprising:

a. a locking means having a plurality of circumferentially disposed engaging means, each said engaging means having first and second sides, said first side arranged and configured to selectively engage the walls of said coaxial pipes such that one of said coaxial pipes is placed in tension with respect to the other and held in position, said second side having at least one inclined surface which matingly engages with at least one setting ring, and said setting ring being positioned in said annulus such that selective movement of each said setting ring causes said first side of said engaging means to be disposed against the walls of said coaxial pipes;

b. a temporary spacing and support plate coupled to said locking means positioning said locking means until said locking means is secured by said engaging means, and supporting said locking means during retrieval of said locking means said support plate arranged and configured in said device so as to be completely removable therefrom such that said temporary spacing and support plate may be coupled to said locking means until said locking means is secured in position, after which said temporary spacing and support plate may be removed without affecting said locking means;

c. bolt means disposed in said device in a general downward direction, said bolt means coupled to said locking means and to said support plate and to each said setting ring such that when said bolt means are selectively moved, each said setting ring engages and disposes said first side of said engaging means against the walls of said coaxial pipes; and packing means for sealing said annulus of said coaxial pipes, said packing means having an annular shape and disposed in said annulus, said packing means being selectively secured to said locking means;

whereby said temporary spacing and support plate may be coupled to said locking means until said locking means is secured in position, after which said spacing and support plate may be removed without affecting said locking means and said packing means may be disposed in position; and after use of said device, said packing means may be removed, said spacing and support plate replaced and secured to said locking means and said locking means may be retrieved.

11. The device of claim 10 wherein said packing means is a resilient material.

12. The device of claim 11 wherein said resilient material is neoprene rubber.

13. The device of claim 10 wherein two setting rings are disposed in said device such that said second side of said engaging means matingly engage with at least one of said setting rings, each said setting ring having a generally rectangular cross section.

14. The device of claim 13 wherein said spacing and support plate is annular in shape with a web and two flanges forming a Z-shaped cross section, one flange arranged and configured to selectively engage the end of one of said coaxial pipes, while the other flange is arranged and configured to selectively engage said locking means.

15. The device of claim 10 wherein said locking means are coupled to pin means such that said locking means may rotate thereabout.

16. The device of claim 10 wherein said engaging means has a spring means disposed thereon above, said spring means urging said engaging means downward.

* * * * *